US009737147B2

(12) United States Patent
Shadley

(10) Patent No.: US 9,737,147 B2
(45) Date of Patent: Aug. 22, 2017

(54) FOLDING CHAIR WITH HINGE

(71) Applicant: Shape Field Office LLC, Oakland, CA (US)

(72) Inventor: Karson Shadley, Oakland, CA (US)

(73) Assignee: Shape Field Office, Oakland, CA (US)

( * ) Notice: Subject to any disclaimer, the term of this patent is extended or adjusted under 35 U.S.C. 154(b) by 87 days.

(21) Appl. No.: 14/698,737

(22) Filed: Apr. 28, 2015

(65) Prior Publication Data

US 2015/0308171 A1 Oct. 29, 2015

Related U.S. Application Data

(60) Provisional application No. 61/986,000, filed on Apr. 29, 2014.

(51) Int. Cl.
*A47C 1/12* (2006.01)
*A47C 4/24* (2006.01)

(52) U.S. Cl.
CPC ..... *A47C 4/24* (2013.01)

(58) Field of Classification Search
CPC .. A47C 4/24; A47C 4/40; A47C 1/026; A47B 2220/0055; F16C 11/04; F16C 11/045; Y10T 403/32098; F16B 7/0493; E05D 5/121
USPC ..... 297/56, 55, 23, 24, 25
See application file for complete search history.

(56) References Cited

U.S. PATENT DOCUMENTS 116,811 A * 7/1871 Collignon et al. ..... A47C 4/24 12/146 C
133,503 A * 11/1872 Travis et al. ..... A47C 4/24 297/56
184,185 A * 11/1876 Sternberg ..... A47C 4/24 297/56
190,974 A * 5/1877 Mahoney ..... A47C 4/24 297/56
204,423 A * 6/1878 Closterman ..... A47C 4/24 297/56
219,289 A * 9/1879 Miller ..... A47C 4/022 297/25
366,980 A * 7/1887 Shuler ..... A47C 4/40 297/23
451,556 A * 5/1891 Hallett ..... G07F 17/14 194/253
481,816 A * 8/1892 Perry ..... G07F 17/14 194/250
596,667 A * 1/1898 Rose ..... A47C 1/026 297/24
882,902 A * 3/1908 Loshbough ..... B62B 7/08 280/642
1,608,911 A * 11/1926 Smith ..... A47C 4/14 248/432

(Continued)

*Primary Examiner* — David R Dunn
*Assistant Examiner* — Alexander Harrison
(74) *Attorney, Agent, or Firm* — Staniford Tomita LLP

(57) ABSTRACT

A folding chair has a backrest, a seat and legs that are coupled to two hinges. The folding chair has an open position and a closed position. In the closed position the backrest portion is parallel to the seat portion and in the open position the angle between the seat portion and the backrest portion is greater than 90 degrees. The hinges are made of two elongated rod structures each having a helical center section. The two elongated rod structures are coupled together with a bolt to form the hinge.

17 Claims, 7 Drawing Sheets

(56) References Cited

U.S. PATENT DOCUMENTS 1,764,914 A * 6/1930 Vande Mark ..... B62B 7/08 280/47.38
1,874,434 A * 8/1932 Brown ..... A47C 4/14 297/331
2,639,762 A * 5/1953 Westcamp ..... A47C 4/24 297/31
2,939,584 A * 6/1960 Bergman, Jr. ..... A47F 5/13 211/27
3,196,465 A * 7/1965 Montgomery ..... A47K 3/122 108/118
3,220,764 A * 11/1965 Duer ..... A47C 4/24 108/120
3,783,458 A * 1/1974 Westrich ..... C23C 14/48 297/56
3,851,915 A * 12/1974 Rodrigo ..... A47C 4/24 108/119
4,008,918 A * 2/1977 Cooper ..... A47D 1/02 297/148
4,011,638 A * 3/1977 Holt ..... E04G 7/16 403/171
4,029,278 A * 6/1977 Napoleon ..... A47C 9/10 248/164
4,036,523 A * 7/1977 Nielsen ..... A47D 1/004 297/130
4,252,367 A * 2/1981 Vanderminden ..... A47C 4/40 297/23
4,322,109 A * 3/1982 Thebaud ..... A47C 4/022 108/118
4,743,068 A * 5/1988 Gomes ..... A47C 4/022 297/18
5,825,095 A * 10/1998 Albecker, III ..... A47C 1/143 297/25
6,056,354 A * 5/2000 Tseng ..... A47C 4/24 297/55
6,257,660 B1 * 7/2001 Calvey ..... A47C 4/38 297/16.1
6,279,991 B1 * 8/2001 Atkins ..... A47C 4/24 297/16.1
6,305,742 B1 * 10/2001 Spendlove ..... A47C 4/24 297/16.1
6,340,205 B1 * 1/2002 Battiston ..... A47K 3/122 108/119
6,345,863 B1 * 2/2002 Laws ..... A47C 4/24 297/447.2
6,354,657 B1 * 3/2002 Nelson ..... A47C 4/40 297/129
6,422,645 B1 * 7/2002 Smith ..... A47C 3/04 297/239
6,478,375 B2 * 11/2002 Richardson ..... A47C 4/24 297/16.1
6,591,778 B1 * 7/2003 Alderman ..... A01K 1/0353 119/28.5
7,331,628 B2 * 2/2008 Lin ..... A47C 4/24 297/16.1
7,410,211 B1 * 8/2008 Lin ..... A47C 4/24 16/31 A
7,938,484 B2 * 5/2011 Leng ..... A47C 4/24 297/23
8,303,041 B2 * 11/2012 Gasser ..... A47B 13/02 248/163.1
8,678,700 B2 * 3/2014 Tsai ..... A47C 4/24 297/16.1
2001/0033100 A1 * 10/2001 Haney ..... A47C 4/20 297/55
2003/0127887 A1 * 7/2003 Laws ..... A47C 4/24 297/55
2003/0168894 A1 * 9/2003 Lin ..... A47C 4/20 297/55
2003/0184132 A1 * 10/2003 Adams ..... A47C 4/14 297/56
2004/0251718 A1 * 12/2004 Degen ..... A47C 4/20 297/55
2005/0206202 A1 * 9/2005 Winter ..... A47C 1/03 297/23
2009/0278335 A1 * 11/2009 Dotsey ..... B62B 7/10 280/647
2012/0326471 A1 * 12/2012 Tsai ..... A47B 3/02 297/56

* cited by examiner

FOLDING CHAIR WITH HINGE

CROSS REFERENCE TO RELATED APPLICATIONS

This application claims priority to U.S. Provisional Application No. 61/986,000, "Hinge For Folding Chair" filed Apr. 29, 2014 which is hereby incorporated by reference in its entirety.

BACKGROUND

Folding chairs are portable chairs that can be unfolded for seating and folded for storage. Folding chairs are designed and manufactured in a variety of forms. Typically, however, a folding chair consists of a seat, a backrest, and foldable support structures, including front and rear legs. In an open configuration, the seat supports the weight of a person while the backrest provides support for the person's back, so the person may comfortably lean back while seated.

BRIEF DESCRIPTIONS OF THE DRAWINGS

DETAILED DESCRIPTION

Figure 1:
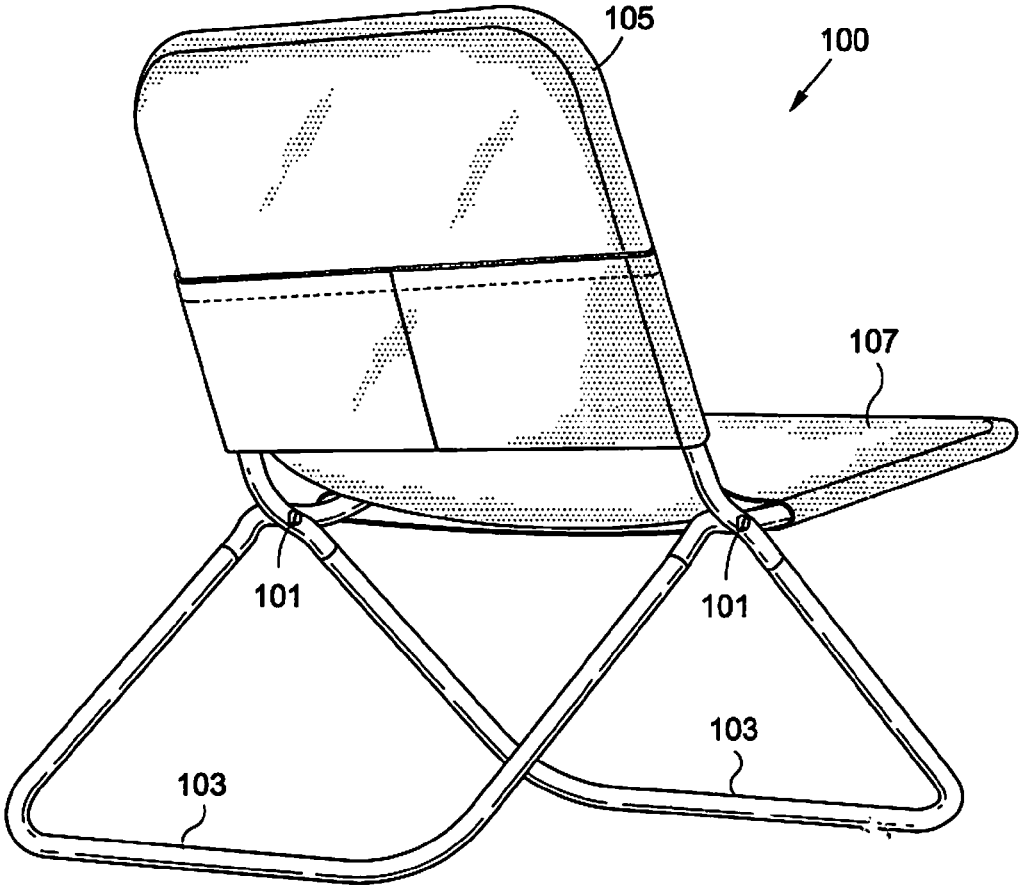
FIG. 1 illustrates a side perspective view of a folding chair that incorporates an embodiment of a hinge.

With reference to FIG. 1, the present invention is directed towards a custom designed chair having hinges, which allow the chair 100 to fold from an expanded chair (shown) into a flatter structure for traveling and storage. The chair 100 can include two hinges 101 that are coupled to opposite sides of the chair 100. The chair 100 can have legs 103, a seat 107 and a backrest 105. The legs 103 can be open tubular sections while the seat 107 and the backrest 105 can be tubular sections covered with a canvas cover. The focus of the folding chair design is a combination of portability and stability, in a lightweight, simple, aesthetically pleasing chair that provides comfortable seating, and high durability. Folding chairs are often used when spending time outdoors where people may want to bring along, and need to handle, multiple items to enjoy the day, or where people may want to simply enjoy their surroundings and relax. The inventive chair is sleek and light enough to be carried on the shoulder, freeing hands to carry other outdoor equipment, and light enough to be carried without much effort.

Figure 2:
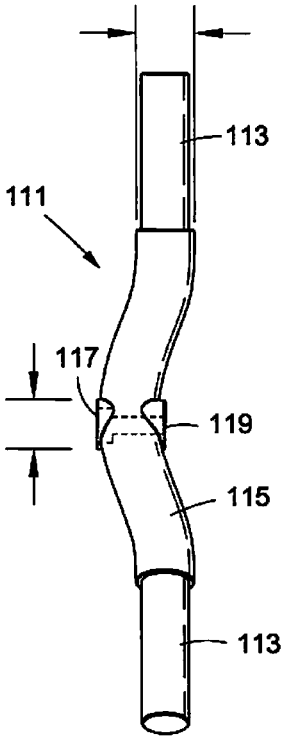
FIG. 2 illustrates a top view of an embodiment of a hinge piece.
Figure 3:
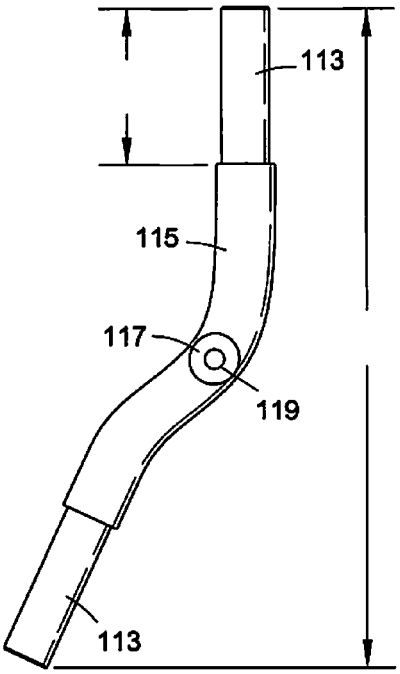
FIGS. 3 and 4 illustrates side views of an embodiment of a hinge piece
Figure 4:
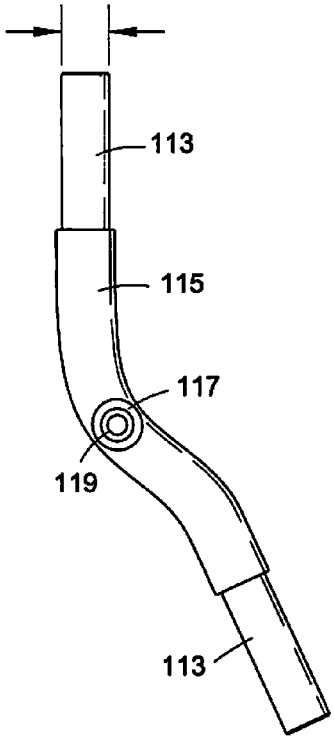
Figure 5:
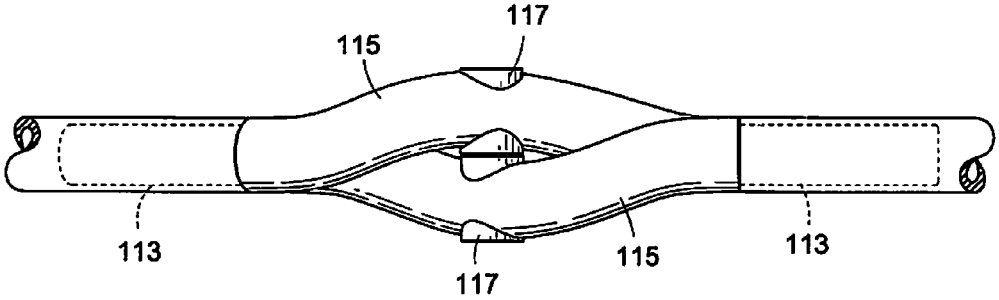
FIG. 5 illustrates a bottom view of an embodiment of an assembled hinge coupled to elongated rods.
Figure 10:
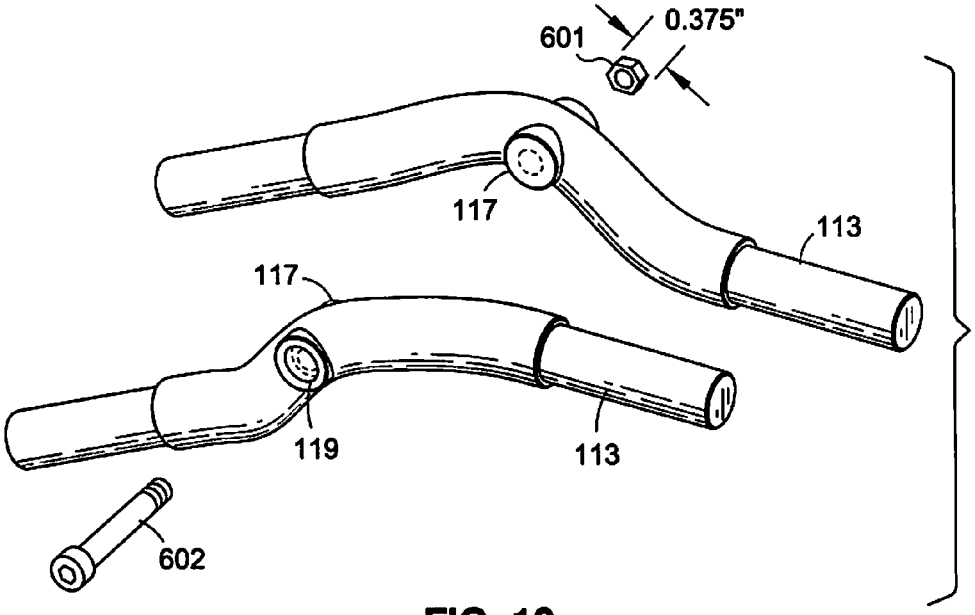
FIG. 10 illustrates an exploded perspective view of an embodiment of a hinge.

With reference to FIGS. 2, 3, 4, and 6, in an embodiment, each hinge 101 includes two elongated rod structures 111 that have straight end portions 113 and a center section 115 having a spiral or helical bend. FIG. 2 illustrates a top view of a single hinge rod structure 111, FIG. 3 illustrates a side view of a single hinge rod structure and FIG. 4 illustrates an opposite side view of the same rod as in FIG. 3. With reference to FIGS. 2 and 7, each elongated rod 111 can also have a cylindrical pivot section 117 having a hole 119 that extends through the center portions of the cylindrical pivot section 117, as illustrated in FIG. 7. In the illustrated embodiment, the cylindrical pivot section 117 can have an outer diameter that is between about 0.375 and 1.000 inch. In the illustrated example, the outer diameter is 0.625 inch and the through hole 121 has a diameter of 0.3875 inch. With reference to FIG. 10, a bolt 601 having an outer diameter of 0.375 can be placed through the hole 119 and used to couple the cylindrical pivot sections 117.

With reference to FIGS. 2 and 4, the elongated rod 111 can have a cross section diameter 121 that is between about 0.5 and 2.0 inches in diameter. In an embodiment, the cross section diameter is 0.75 inch. The ends 113 of the elongated rod structure 111 can have a smaller diameter 123 that is concentric with the outer diameter of the center section 115. In an embodiment, the cross section diameter of the smaller diameter is 0.6 inch. The transitions 125 between the ends 113 and the main portion of the elongated rod structure 115 can be a circular edge.

Figure 6:
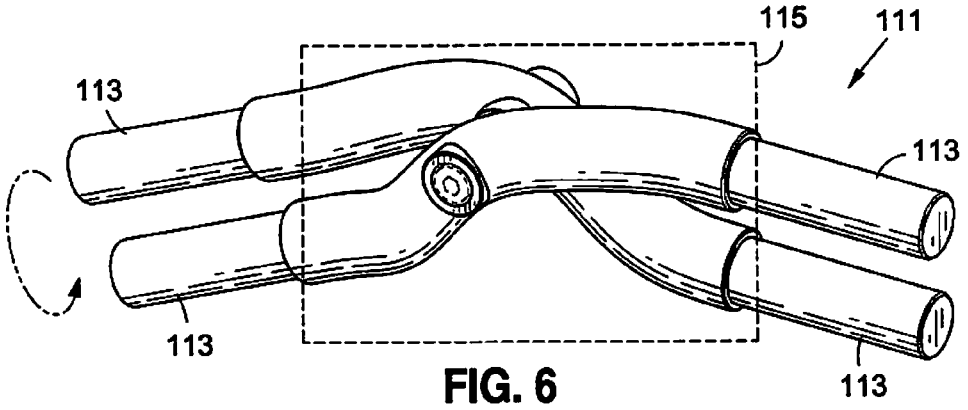
FIG. 6 illustrates a perspective view of an embodiment of an assembled hinge.
Figure 7:
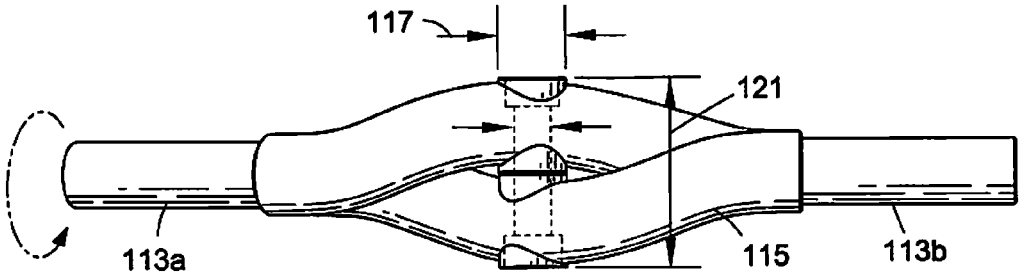
FIG. 7 illustrates a bottom view of an embodiment of a hinge.
Figure 8:
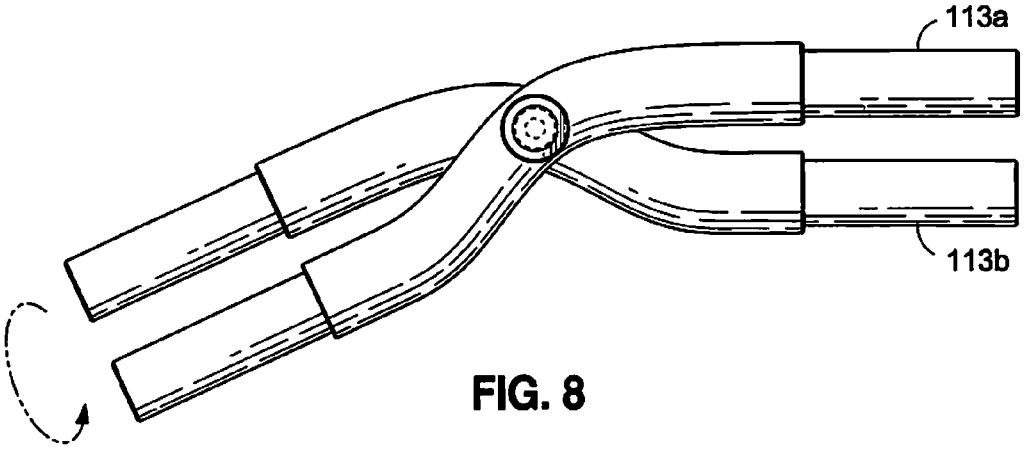
FIG. 8 illustrates a side view of an embodiment of a hinge.
Figure 16:
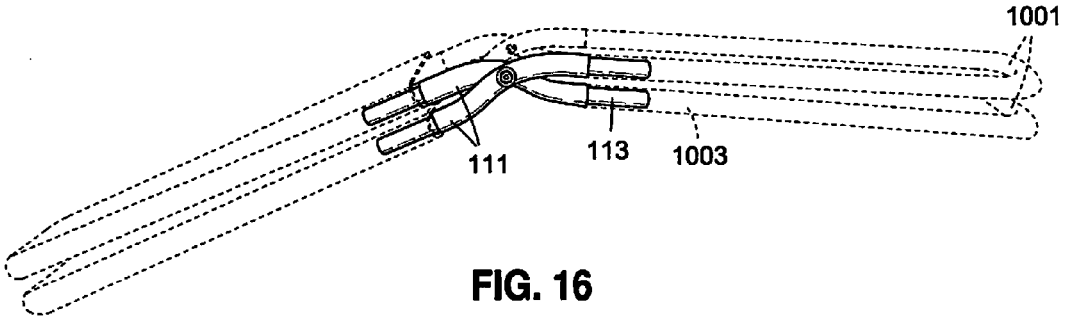
FIG. 16 illustrates a side perspective view of a folding chair having an embodiment of a hinge in a closed position.
Figure 17:
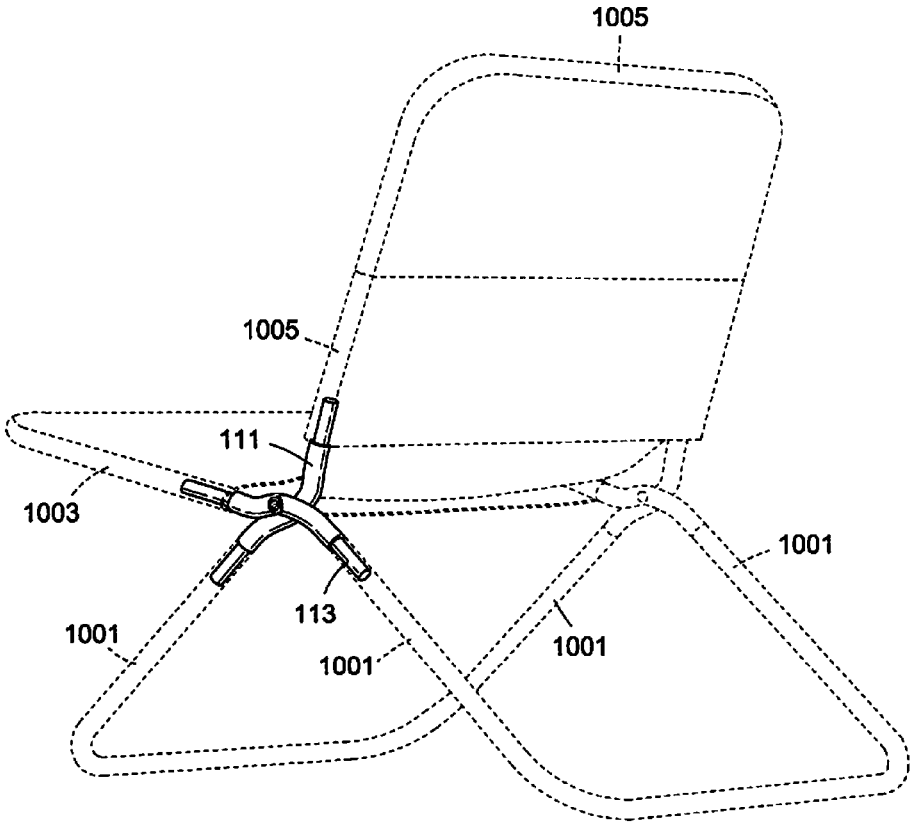
FIG. 17 illustrates a rear perspective view of a folding chair having an embodiment of a hinge in an open position.

With reference to FIGS. 6, 16, and 17, the ends 113 of the elongated rod structure 111 can be inserted into the leg 1001, seat 1003 and backrest 1005 structures, which are formed from bent tubes. The leg 1101, seat 1003 and backrest 1005 tube portions can have an outer diameter that is the same or similar to the outer diameter 121 of the elongated rods 111 and the inner diameter can be very close to the outer diameter 123 of the straight end portions 113.

FIGS. 5, 6, 7, 8, and 12 illustrate the hinge 101 in the assembled configuration. In an embodiment, the device connecting the rod structures 111 may be an axle, welding, a screw, or any other pin and shaft combination connecting the two helical couplings. The axle may be military grade. With reference to FIG. 10, the two cylindrical pivot sections 117 can be aligned with each other and held together with a nut 601 and bolt 602 fasteners that extends through the two cylindrical pivot sections 117. The nut 601 and bolt 602 can be tightened to secure the two cylindrical pivot sections 117 together. The nut 601 and bolt 602 can be at least partially or entirely recessed within the two cylindrical pivot sections 117. This bolt can be a recessed hex head bolt and nut, or other head stud combination. In an embodiment, the bolt may be a CAD recessed hexagonal headbolt and nut device. The shoulder of the connecting device may protrude from the hinge. For instance, the device may protrude anywhere from 0.0-1.5 inches from the hinge. In an embodiment, a bolt 602 and nut 601 device protrudes 0.1 inches on the inside of the hinge. The heads of both nut and bolt may have ends that allow the user to tighten and loosen them. For example, the bolts may have Allen or hex wrench heads in order for a user to tighten them.

Figure 12:
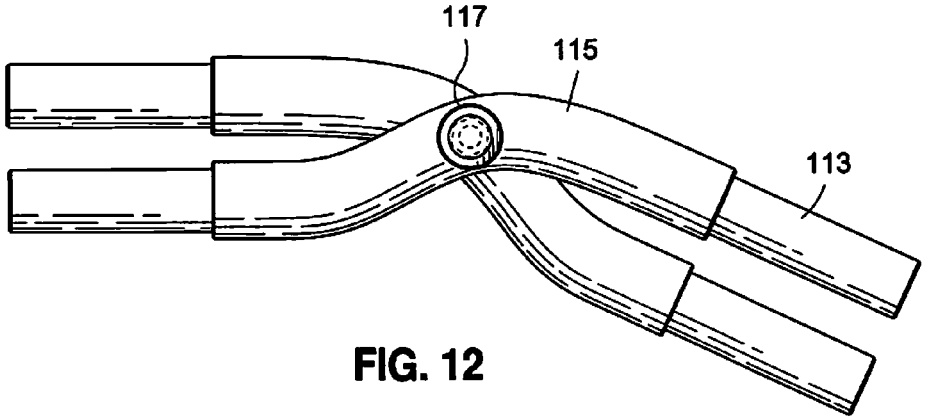
FIG. 12 illustrates a side view of an embodiment of a hinge.
Figure 15:
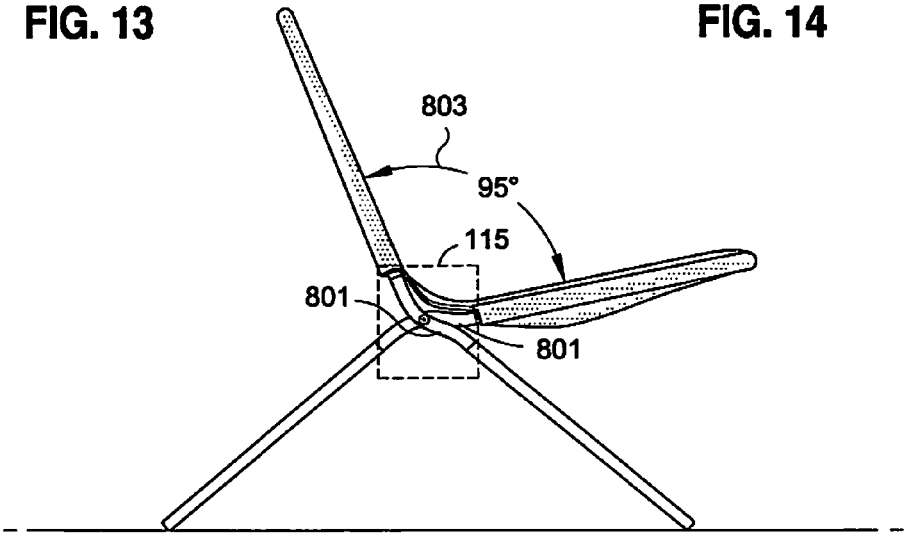
FIG. 15 illustrates side view of a folding chair having an embodiment of a hinge in an open position.

The hinges can have a closed position, as in FIGS. 12 and 16, when the chair is in the closed state, and an open position, as in FIGS. 15 and 17, when the chair is expanded for use.

Figure 14:
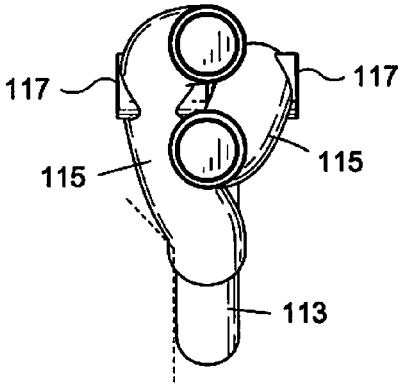

As discussed, the cross section geometry of these hinge 111 and/or frame structures may be circular, as illustrated in FIG. 14. In other embodiments, the tubular hinge piece 111 cross section may have other geometries, such as polygonal, triangular, or quadrilateral shapes such as rectangle, rhombus. The geometry of the inner surface of a hollow frame may be different than the geometry of the outer surface of the frame, or the geometries may be substantially the same. The geometry of the outer surface of the hinge may vary by section. For instance, it may be mostly circular, except for a pinched section at the center and/or ends of the hinge structures and/or at the corners of the frame structure.

Figure 9:
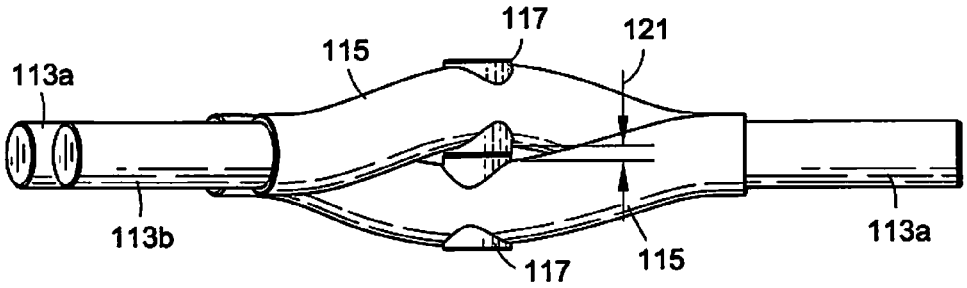
FIG. 9 illustrates a top view of an embodiment of a hinge.
Figure 13:
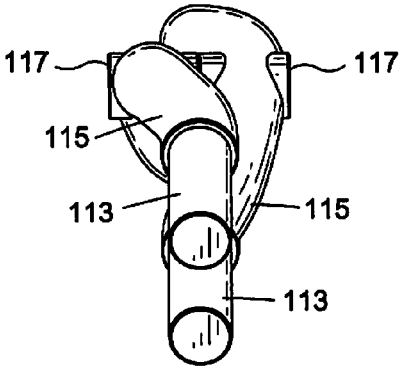
FIGS. 13 and 14 illustrate end views of an embodiment of a hinge.

In an embodiment, the tubular parts are intertwined with each other in a helical conformation, as illustrated in FIGS. 12, 13, and 14. The center sections 115 are bent in a helical shape, such that when coupled, the center sections 115 are bent around each other. As seen from the view of FIGS. 5 and 9, there is a small distance 121 between the center sections 115. The distance between center sections 115 may be anything between the distance of the width of a few molecules of lubricating liquid, to several inches. The angle of torsion, or dihedral angle, of the helical tubes may be anything between 1 and 360 degrees. In an embodiment, it is 180 degrees. In another embodiment, the degree of curvature of the hinge portions is 1-180 degrees.

FIGS. 12, 13, and 14 illustrate the helical shape of the hinge in the closed state. In the closed state, the hinge can have a helical shape with the two elongated rods intertwine around each other at the center portion, substantially where the pivot sections 117 are located. This coupling structure offers flexibility and strength, may be able to support 300 lbs. or more. The straight end sections of the two hinge pieces can be substantially parallel to each other in a single plane.

Figure 11:
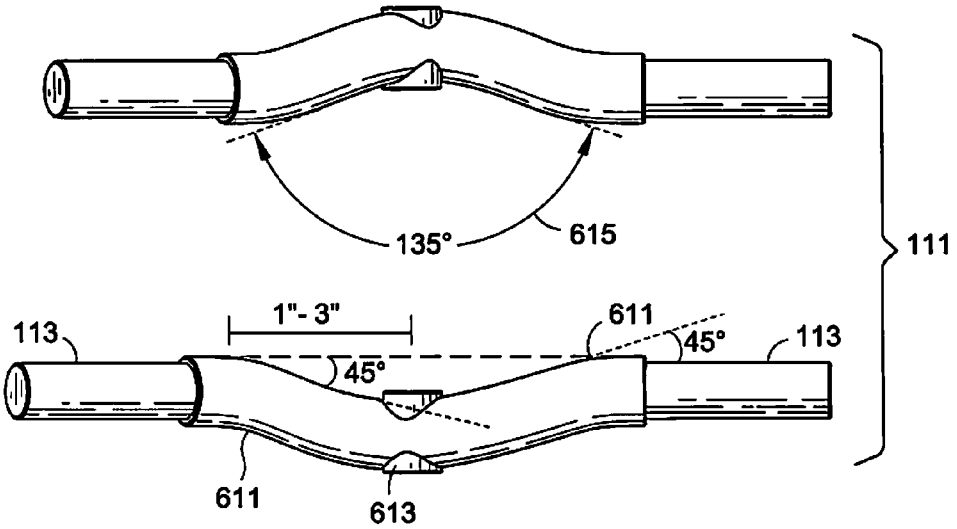
FIG. 11 illustrates a top view of an embodiment of two hinge pieces.

With reference to FIG. 1, an embodiment of a folding chair that has a rotatable hinge made of two similarly or identically shaped elongated rods 111 that are coupled together at a center section 115. The elongated rods 111 of the hinges 101 may preferably be solid but may also be tubular parts in other embodiments. The elongated rods 111 of the chair can be identical parts which curve substantially symmetrically from the center of their length and out toward their ends, as illustrated in FIG. 14. In an embodiment, the hinge portions consist of three gradual curves, as illustrated in FIG. 11. In an embodiment, the hinge portion first curves in one direction 611. The curvature in this first direction can be between 10 and 45 degrees relative to the straight ends 113 of the elongated rods 111. At a point close to the first curve of the center section 115, there is a second curve 613 to return the tube to substantially the original plane. This second curve 613 may occur at a point about 1-3 inches from the first curve. The second curve 613 may be substantially in the form of an arch. In an embodiment, the arc angle 615 is less than 180 degrees. For instance, the arc angle can be 135 degrees. The second portion of this arc is not on the same plane as the first portion of the arc. The second half of the arc bends toward a plane about 45 degrees from the plane of the first part of the hinge, as illustrated in FIG. 14. The second portion of the arc then makes another bend at about 5-45 degrees, which essentially straightens out the center section 115 such that it runs parallel to the first portion of hinge, as illustrated in FIG. 11.

In another embodiment, the substantially similarly-shaped structures are substantially rectangular frames, as illustrated in FIGS. 16 and 17, having curved hinge portions 111 at substantially the middle portion of their long sides. These frames may be tubular parts, which are identical, repeated parts. With reference to FIG. 16, the short side segments 1001 of the substantially rectangular frame may serve as the top, or bottom portions of the chair. The short side segments may be 15-30 inches. In an embodiment, the short side segments are 20 inches. The long side segments 1003 of the substantially rectangular frame may be between 30-60 inches.

In an embodiment, these structures may be made of a substantially solid and rigid material. This material may be aluminum, such as 6061-T6 aluminum. In other embodiments, the tubular hinge structures may have a hollow inner area. In an embodiment, the hinge structures may have a resistant coating. This coating can be a hard, anodized aluminum to make the structure resistant to scratching and denting. In another embodiment, the hinge structures may be coated with another substance. This substance may be soft or rigid, thick or thin. For example, the coating may be a thin coat of a soft, low friction plastic that is 0.005 inches thick.

Figure 19:
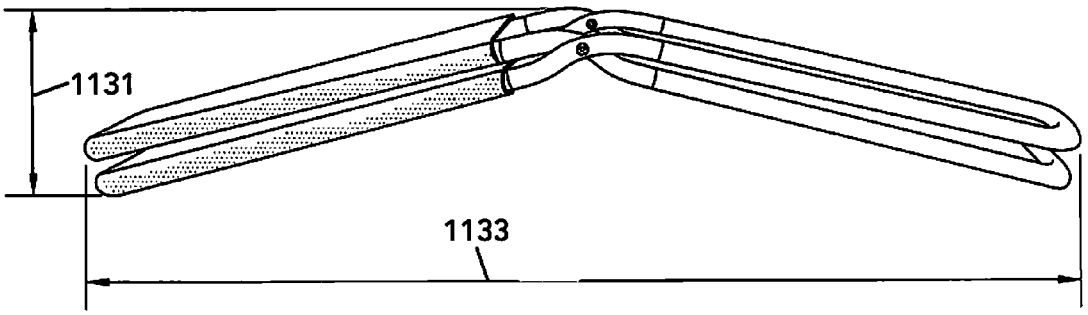
FIG. 19 illustrates a side view of a folding chain having an embodiment of a hinge in a closed position.

In the closed position, the ends of the chair's two similarly shaped structures are substantially close to each other and parallel to each other, as illustrated in FIGS. 16 and 19. They may be very proximate to each other at about 0.01-4 inches apart, making the thickness of the folded chair 4-8 inches. In an embodiment, the thickness of the chair in its folded conformation is 6 inches, and its length is 33 inches.

Figure 18:
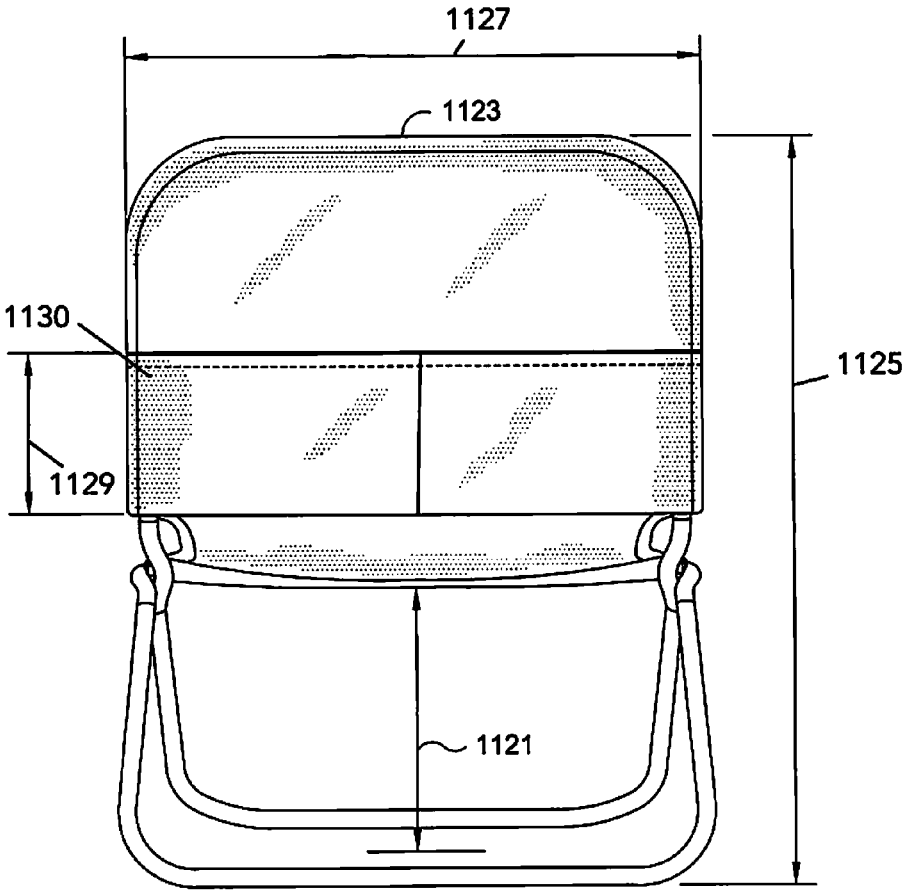
FIG. 18 illustrates a rear view of a folding chair having an embodiment of a hinge in an open position.

In the open position illustrated in FIGS. 15, 17 and 18, the curvature of the helical center sections 115 can contact each other when the elongated rod structures are approximately perpendicular to prevent further relative rotational movement. In the open position, the hinge swings more than 90 degrees until contact between the hinge pieces 111 at contact points 801 function as a stop, preventing further rotational movement. There are contact points 801 at the outer ends of the helically shaped hinge portions 111. The contact points 801 of the hinge pieces 111 function as a stopping point to the chair's collapse when the chair is open. The contact points 801 may be reinforced. The reinforced portion may be more solid, lined, padded, or otherwise reinforced. The contact points 801 may further contain a locking mechanism to increase the frictional force to combat the sliding force placed on the contact points 801 as a result of weight on the chair. The contact points 801 may have indentations, protrusions, frictional devices, or other means of preventing the tubes from slipping past the contact points 801. The hinge pieces 111 swing open enough to allow for a comfortable seat angle 803. The seat angle 803 can be between 90 and 180 degrees.

Reference is made to FIGS. 1 and 18. In an embodiment, in the open position, the seat portion 107 of the chair is a distance 1121 from the floor that is equivalent to the average length between the foot and knee of an adult person. This distance 1121 may be between 5 and 20 inches from the floor. For example, the seat portion 107 of the chair may be 10 inches from the floor.

In an embodiment, the back support 105 of the chair in the open position may be as long as the average back of an adult person. This length may be between 20 and 40 inches. For example, the back support 105 may be 16 inches.

In an embodiment, the ends of the hinge portions may be rigidly coupled to elongated members that make up the of the chair, including the back support 105 frame and the weight-supporting legs 103 of the chair. In an embodiment, the frame components are tubular structures that have a very close fit around the ends of the hinge pieces and but up against the raised edges. The tubular frame pieces can be attached to the hinge pieces with an adhesive, fasteners, welds, friction, interference press fitting, or any other suitable attachment mechanisms. The adhesive may be an industrial strength glue. The fasteners may be retractable button and hole structures. The tubular frame pieces may also be of the same material and finish embodiments as previously discussed for the hinge portion. The tubular frame pieces may also be of different material and finish materials as those previously discussed for the hinge portion.

In an embodiment, the frame members of the chair may be wrapped with protective material around the portions in contact with the ground 113. Such material may be a tough material such as leather, rubber, plastic, or canvas, or padded embodiments thereof. This material may cover small portions of the frame of the chair, or the entire length of the frame. In an embodiment, the leg segments 113 of the frame are kept from splaying farther apart than intended in the open position by a non-stretching material coupled to the front leg segments 113 on one end, and the back leg segments 113 on the other end.

The frame members of the chair are coupled to fabric material such that the fabric material is held extended in order to form a sustaining seating portion and back support portion, as illustrated in FIG. 1. In an embodiment, the fabric material may be adhesively coupled to the frame. The adhesive may be glue, fiber or synthetic stitching, Velcro, or another coupling mechanism. In another embodiment, the fabric material has a closed loop conformation for the frame to pass through at one or more edges of the material. The portion of the material that forms a closed loop may be in small sections along the length of the frame, or it may be along substantially the entire length of a side of the frame. In another embodiment, the fabric material is a double ended sleeve with one sleeve portion as the seat 107 and the other sleeve portion as the back rest 105.

In an embodiment the fabric material is a hard canvas. In an embodiment, the fabric may be waxed. In another embodiment, the fabric may be #8 Duck heavyweight waterproof canvas. This fabric would resist rain, abrasion, and patina. In another embodiment, the fabric is a synthetic fiber. For example, the fabric may be a plastic, or polyester, or a synthetic blend. In another embodiment, the fabric is a natural fiber such as cotton.

In an embodiment, the canvas may be a solid piece of material having two large pockets that fit over the seat portion and the backrest portion of a chair frame. The canvas can have a length 1122 and a width 1123. In an embodiment, the lengths 1122 of the backrest, seat and legs can be about 10-25 inches and the widths can be about 15-30 inches. The angle between the seat and the backrest can be about 90-105 degrees. In the opened position shown in FIG. 18, the height of the chair 1125 can be about 20-30 inches, and the height of the hinges 1121 can be about 5-15 inches. In an embodiment, the width 1127 of the seat and the width 1127 of the backrest portions can be about 20 inches wide and the distance to the ends of the backrest, seat and legs from the center of the hinges can be about 17.5 inches and in an open position, the height of the chair can be about 26 includes. The angle between the seat and the backrest can be about 95 degrees. With reference to FIG. 19, in the closed position, the folding chair can be about 25-40 inches in length 1133 and the closed height 1131 can be about 2-10 inches. In an embodiment, a length 1133 of the folding chair can be about 33 inches in and about 6 inches in height 1131.

In another embodiment, the canvas may form the seat and back portions out of strips. The strips may be in parallel, or perpendicular, or a combination of parallel and perpendicular. For example, the strips may be 1-4 inches wide. The gap between strips may be ¼ of an inch.

In an embodiment, the back support portion of canvas may have pockets 1130. In an embodiment, these pockets 1130 may be on the lower rear side of the back support portion. The depth 1129 of the pockets 1130 may be 6 inches deep. The pockets 1130 may be of the same canvas material as the seat and back support portions. In an embodiment, the pockets 1130 are entirely of #8 Duck heavyweight waterproof canvas. The pockets 1130 may be sewn, glued, or otherwise adhered onto the canvas.

In an embodiment, the entire chair, with hinge portions, frame pieces, and fabric material, is light, as compared to traditional folding chairs. In an embodiment, the chair weighs under 4 lbs. The simple design of the disclosed folding chair makes the present invention sleek and light. It is sleek enough to be ultra-light and easy to carry. The simple, open frame design allows it to be easily carried on the shoulder like a satchel. This frees the user's hands to carry other items, such as drinks, and fishing tools, etc.

The present disclosure, in various embodiments, includes components, and apparatus substantially as depicted and described herein, including various embodiments, sub-combinations, and subsets thereof. Those of skill in the art will understand how to make and use the present disclosure after understanding the present disclosure. The present disclosure, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation. Rather, as the flowing claims reflect, inventive aspects lie in less than all features of any single foregoing disclosed embodiment.

What is claimed is:

1. A hinge for a folding chair comprising:

a first hinge structure having a first hole;

a second hinge structure having a second hole, the second hinge structure is identical to the first hinge structure; and a bolt placed through the first hole and the second hole for securing the first hinge structure to the second hinge structure;

wherein the first hinge structure has a first center section bent in a helical shape and the first hinge structure has a first contact point and the second hinge structure has a second contact point and the first contact point and the second contact point function as a stop to prevent rotational movement of the first hinge structure relative to the second hinge structure.

2. The hinge of claim 1 wherein the center section of the first hinge structure includes a first cylindrical pivot section that surrounds the first hole, the first cylindrical pivot section having an outer diameter.

3. The hinge of claim 2 wherein a head portion of the bolt is recessed within the first cylindrical pivot section.

4. The hinge of claim 3 further comprising:

a nut secured to a threaded portion of the bolt.

5. The hinge of claim 4 wherein the second hinge structure includes a second center section having a second cylindrical pivot section that surrounds the second hole, the first cylindrical pivot section having an outer diameter.

6. A hinge for a folding chair comprising:

a first hinge structure having first straight end sections and a first center section having a first helical shape and a first hole;

a second hinge structure having second straight end sections and a second center section having a second helical shape and a second hole; and a bolt placed through the first hole and the second hole for securing the first hinge structure to the second hinge structure;

wherein the first hinge structure has a first center section bent in a helical shape and the first hinge structure has a first contact point and the second hinge structure has a second contact point and the first contact point and the second contact point function as a stop to prevent rotational movement of the first hinge structure relative to the second hinge structure.

7. The hinge of claim 6 wherein the hinge has a closed position wherein the first straight end section is substantially parallel to the second straight end section.

8. The hinge of claim 6 wherein the center section of the first hinge structure includes a first cylindrical pivot section that surrounds the first hole, the first cylindrical pivot section having an outer diameter.

9. The hinge of claim 8 wherein a head portion of the bolt is recessed within the first cylindrical pivot section.

10. The hinge of claim 9 further comprising:

a nut secured to a threaded portion of the bolt.

11. The hinge of claim 10 wherein the second hinge structure includes a second center section having a second cylindrical pivot section that surrounds the second hole, the second cylindrical pivot section having an outer diameter.

12. A folding chair comprising:

a seat portion;

a backrest portion;

a first leg portion;

a second leg portion;

a first hinge structure having first straight end sections and a first center section having a first helical shape and a first hole;

a second hinge structure having second straight end sections and a second center section having a second helical shape and a second hole; and a bolt placed through the first hole and the second hole for securing the first hinge structure to the second hinge structure;

wherein the backrest portion is coupled to the first straight end section of the first hinge structure and the seat portion is coupled to the second straight end section of the second hinge structure and the first hinge structure has a first contact point and the second hinge structure has a second contact point and the first contact point and the second contact point function as a stop to prevent rotational movement of the first hinge structure relative to the second hinge structure.

13. The folding chair of claim 12 wherein the first leg portion is coupled to the first straight end section of the first hinge and the second leg portion is coupled to the second straight end section of the second hinge.

14. The folding chair of claim 12 wherein tubular portions of the backrest portion and the seat portion are substantially identical.

15. The folding chair of claim 12 wherein tubular portions of the backrest portion and the first leg portion are substantially identical.

16. The folding chair of claim 12 wherein tubular portions of the seat portion and the first leg portion are substantially identical.

17. The folding chair of claim 12 wherein the hinge has a closed position and an open position, therein a rotation of the first hinge structure relative to the second hinge structure between the closed position and the open position is greater than 90 degrees.

* * * * *